US011217151B2

(12) United States Patent
Zhang et al.

(10) Patent No.: US 11,217,151 B2
(45) Date of Patent: Jan. 4, 2022

(54) PIXEL CIRCUIT WITH TWO DRIVING CIRCUITS, AND ARRAY SUBSTRATE AND DISPLAY PANEL COMPRISING THE SAME

(71) Applicant: WUHAN TIANMA MICRO-ELECTRONICS CO., LTD., Wuhan (CN)

(72) Inventors: Litao Zhang, Wuhan (CN); Dongliang Dun, Wuhan (CN); Zhiqiang Xia, Wuhan (CN); Ruiyuan Zhou, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/006,907

(22) Filed: Aug. 31, 2020

(65) Prior Publication Data

US 2020/0402449 A1 Dec. 24, 2020

(30) Foreign Application Priority Data

Jun. 29, 2020 (CN) ..... 202010603429.5

(51) Int. Cl.
*G09G 3/32* (2016.01)

(52) U.S. Cl.
CPC ..... *G09G 3/32* (2013.01); *G09G 2310/0272* (2013.01)

(58) Field of Classification Search
CPC ..... G09G 3/32
(Continued)

(56) References Cited

U.S. PATENT DOCUMENTS

2010/0013816 A1* 1/2010 Kwak ..... G09G 3/3233 345/211
2010/0302285 A1 12/2010 Yamanaka et al.
(Continued)

FOREIGN PATENT DOCUMENTS

CN 101903934 A 12/2010
CN 103137067 A 6/2013
(Continued)

OTHER PUBLICATIONS

Office Action of CN Patent Applicaiton No. 202010603429.5.

*Primary Examiner* — Long D Pham
(74) *Attorney, Agent, or Firm* — Kilpatrick Townsend & Stockton, LLP

(57) ABSTRACT

A pixel circuit, an array substrate, and a display panel. The pixel circuit includes an initializing device, a data writing device, a control device, and a current supplementing device. In a light-emitting phase of a driving period of the pixel circuit, a control signal controls the control device to generate a first driving current, and controls the current supplementing device to generate a second driving current. The first driving current and the second driving current are transmitted to a light-emitting unit, and drive the light-emitting unit together for light emission. Currents flowing through the control device and the current supplementing device, respectively, are reduced while meeting a requirement of providing a large driving current to the light-emitting unit. A control capability of the pixel unit on a current of the light-emitting unit is less likely to be weakened, and a display effect is improved.

16 Claims, 12 Drawing Sheets

(58) Field of Classification Search
USPC ..... 345/76
See application file for complete search history.

(56) References Cited

U.S. PATENT DOCUMENTS

| | | | | |
|---|---|---|---|---|
| 2013/0141316 | A1 | 6/2013 | Lee et al. | |
| 2018/0047337 | A1 | 2/2018 | Chen et al. | |
| 2018/0130419 | A1 | 5/2018 | He et al. | |
| 2018/0166025 | A1 | 6/2018 | Zhou et al. | |
| 2018/0175074 | A1 | 6/2018 | Kurokawa | |
| 2019/0180686 | A1 | 6/2019 | Qu et al. | |
| 2020/0234650 | A1* | 7/2020 | Zhu | G09G 3/3233 |
| 2020/0380915 | A1* | 12/2020 | Yoon | H01L 27/3262 |

FOREIGN PATENT DOCUMENTS

| | | | |
|---|---|---|---|
| CN | 106023900 | A | 10/2016 |
| CN | 106910468 | A | 6/2017 |
| CN | 107342043 | A | 11/2017 |
| CN | 107358917 | A | 11/2017 |
| CN | 108039149 | A | 5/2018 |
| CN | 110473494 | A | 11/2019 |
| CN | 110491338 | A | 11/2019 |
| CN | 110599964 | A | 12/2019 |
| CN | 111210762 | A | 5/2020 |

* cited by examiner

PIXEL CIRCUIT WITH TWO DRIVING CIRCUITS, AND ARRAY SUBSTRATE AND DISPLAY PANEL COMPRISING THE SAME

CROSS-REFERENCE TO RELATED APPLICATIONS

This application claims the priority to Chinese Patent Application No. 202010603429.5, titled "PIXEL CIRCUIT, ARRAY SUBSTRATE, AND DISPLAY PANEL", filed on Jun. 29, 2020 with the China National Intellectual Property Administration, the contents of which are incorporated herein by reference.

FIELD

The present disclosure relates to the field of display, and particularly, to a pixel circuit, an array substrate, and a display panel.

BACKGROUND

A pixel circuit is an important structure in various display panels, for controlling light-emitting elements to display on requirement.

Generally, the pixel circuit that controls the light-emitting elements has a complex structure in a new-type display panel, such as an organic light emitting diode (OLED) display panel, a micro-light emitting diode (Micro-LED) display panel, and a quantum dot display panel. The pixel circuit usually includes a light-emitting control device, an initializing device, and a data writing device, which are composed of a capacitor and multiple thin film transistors. The light-emitting control device drives the light-emitting element directly for light emission.

The pixel circuit may be required to drive the light-emitting unit with a large current, in order to meet a design requirement. In such case, the thin film transistors in the light-emitting control device of the pixel circuit may operate in a linear region, weakening a control capability of the pixel circuit on a current flowing through the light-emitting element, and resulting in an abnormal display of the display panel.

SUMMARY

In order to address the above issues, a pixel circuit, an array substrate and a display panel are provided according to embodiments of the present disclosure. Thereby, a control device is less likely to operate in a linear region in a case that the pixel circuit is required to provide a large current to a light-emitting unit, and an abnormal display due to the control device operating in the linear region is less probable.

A pixel circuit is provided, including an initializing device, a data writing device, a control device, and a current supplementing device.

Each control end of the initializing device, the data writing device, the control device, and the current supplementing device is configured to receive a control signal.

The initializing device further includes a first input end, and the data writing device further includes a second input end. The first input end is configured to receive a reference signal, and the second input end is configured to receive a data signal.

The control device further includes a first power input end and a first output end, and the current supplementing device further includes a second power input end and a second output end. The first power input end and the second power input end are both configured to receive an operating voltage, the first output end is configured to output a first driving current, and the second output end is configured to output a second driving current.

A driving period of the pixel circuit includes a light-emitting phase.

In the light-emitting phase, the control signal is configured to control operation of the control device, so that the control device generates the first driving current according to the data signal and the operating voltage, and the first driving current is transmitted to a light-emitting unit. The control signal is further configured to control operation of the current supplementing device, so that the current supplementing device generates the second driving current according to the data signal and the operating voltage, and the second driving current is transmitted to the light-emitting unit. The light-emitting unit is driven by the first driving current and the second driving current for light emission.

An array substrate is further provided, including: a substrate, multiple display units arranged in an array on the substrate, and a pixel circuit electrically connected to the display units. The pixel circuit includes any one of the foregoing the pixel circuit.

A display panel is further provided, including the forgoing array substrate and an opposite substrate which are disposed opposite to each other.

The pixel circuit, the array substrate, and the display panel are provided according to embodiments of the present disclosure. The pixel circuit includes the initializing device, the data writing device, the control device, and the current supplementing device. In the light-emitting phase of the driving period of the pixel circuit, the control device operates under control of the control signal, to generate the first driving current transmitted to the light-emitting unit. The current supplementing device operates under control of the control signal, to generate the second driving current transmitted to the light-emitting unit. The light-emitting unit is driven by the first driving current and the second driving current for light emission. A current driving the light-emitting unit for light emission is a sum of the first driving current and the second driving current. Therefore, currents that flowing through the control device and the current supplementing device, respectively, are reduced (that is, the first driving current and the second driving current are reduced) while meeting a requirement of providing a large driving current to the light-emitting unit. The control device and the current supplementing device are less likely to operate in a linear region, in a case that the pixel circuit is required to provide a large current to the light-emitting unit. Thereby, a control capability of the pixel unit on a current of the light-emitting unit is less likely to be weakened, and a display effect is improved.

BRIEF DESCRIPTION OF THE DRAWINGS

Embodiments of the present disclosure, hereinafter are briefly described the drawings to be applied in embodiments of the present. Apparently, the drawings in the following descriptions are only some embodiments of the present disclosure.

DETAILED DESCRIPTION

As mentioned in the background, thin film transistors that serve as a control device may operate in a linear region, in a case that a pixel circuit is required to drive a light-emitting unit with a large current. Specifically, without changing a structure of the pixel circuit, a voltage of a data signal inputted into the pixel circuit usually needs to be reduced to increase the driving current supplied from the pixel circuit to the light-emitting unit. In such process, a voltage at an anode of the light-emitting unit increases, which may cause the thin film transistor to operate in the linear region due to a gate-to-drain voltage being lower than a threshold voltage of the thin film transistor (where P-channel thin film transistors is taken as an example). The thin film transistor operating in the linear region is less capable to modulate a driving current provided for the light-emitting unit. Thereby, the whole pixel circuit is less capable to modulate the driving current, that is, less capable to control brightness of the light-emitting unit, resulting in an abnormal display of the whole display panel.

In order to solve the problems, a pixel circuit, an array substrate, and a display panel are provided according to embodiments of the present disclosure. The pixel circuit includes an initializing device, a data writing device, a control device, and a current supplementing device. In a light-emitting phase of a driving period of the pixel circuit, the control device operates under control of a control signal, to generate a first driving current transmitted to a light-emitting unit. The current supplementing device operates under control of the control signal, to generate a second driving current transmitted to the light-emitting unit. The light-emitting unit is driven by the first driving current and the second driving current for light emission. A current driving the light-emitting unit for light emission is a sum of the first driving current and the second driving current. Therefore, currents that flowing through the control device and the current supplementing device, respectively, are reduced (that is, the first driving current and the second driving current are reduced) while meeting a requirement of providing a large driving current to the light-emitting unit. The control device and the current supplementing device are less likely to operate in a linear region, in a case that the pixel circuit is required to provide a large current to the light-emitting unit. Thereby, a control capability of the pixel unit on a current of the light-emitting unit is less likely to be weakened, and a display effect is improved.

Embodiments of the present disclosure are described clearly and completely in conjunction with the drawings in embodiments of the present closure. Apparently, the described embodiments are only some rather than all of the embodiments of the present disclosure.

Figure 1:
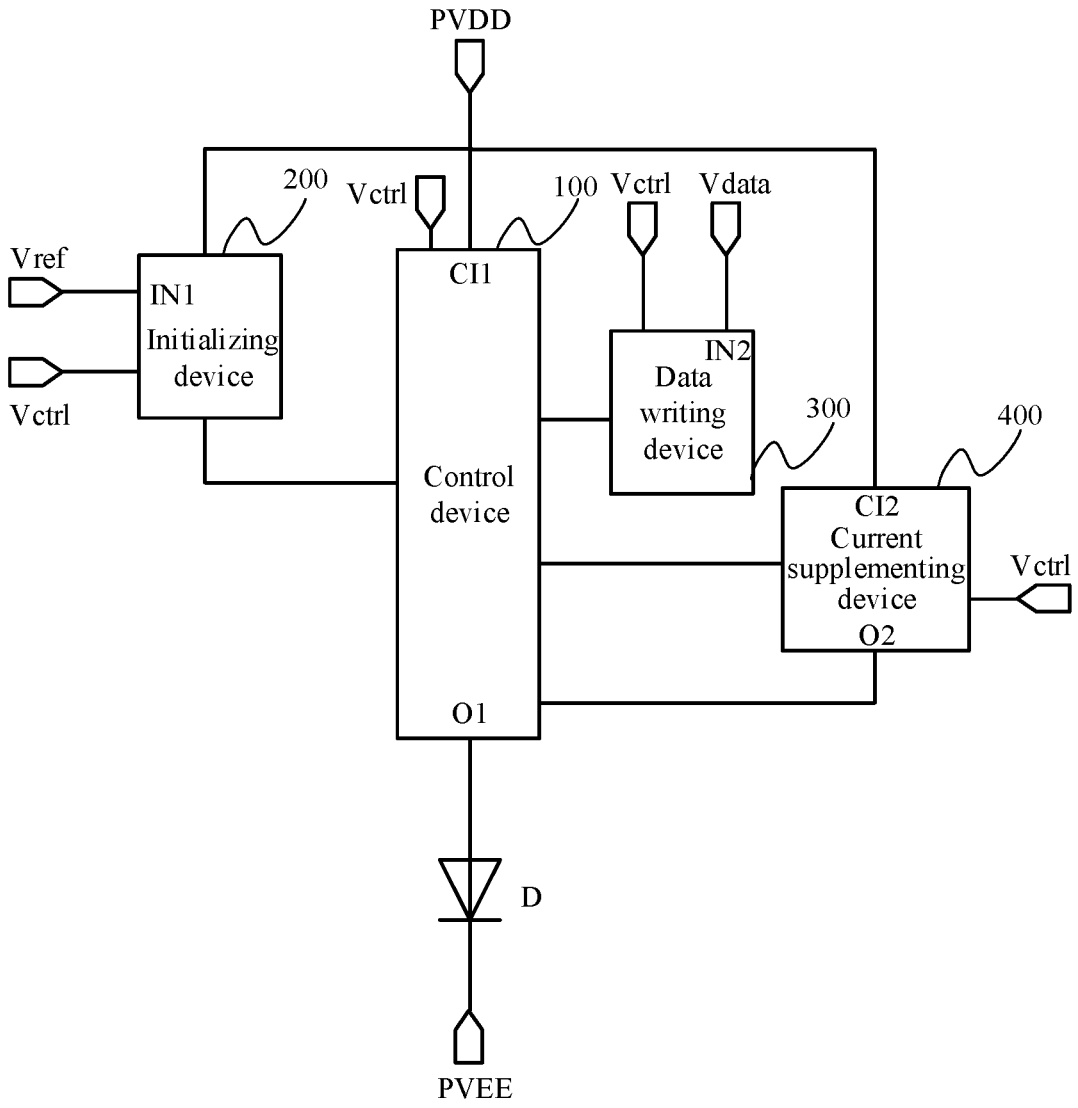
FIG. 1 is a schematic structural diagram of a pixel circuit according to an embodiment of the present disclosure.
Figure 2:
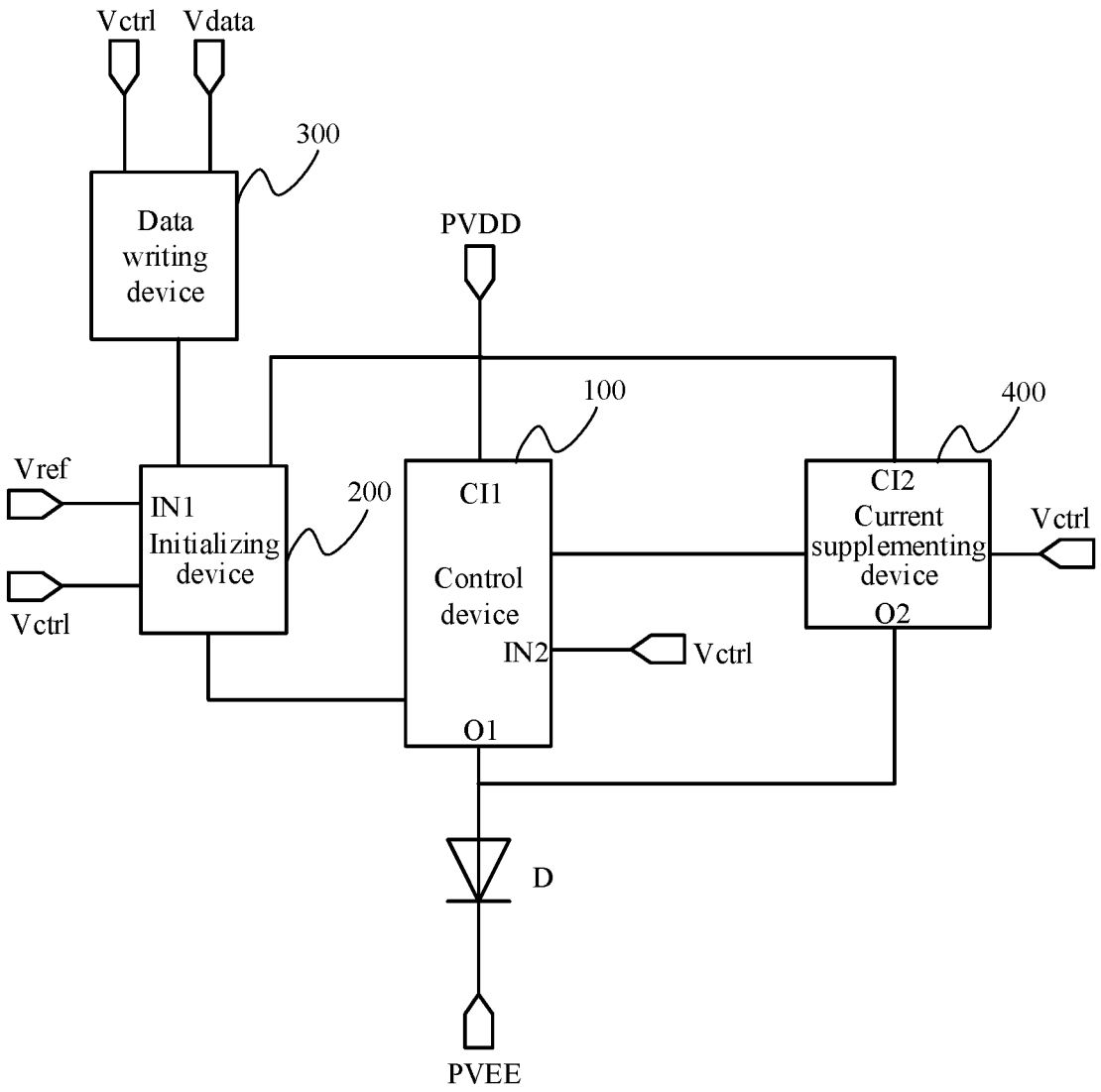
FIG. 2 is a schematic structural diagram of a pixel circuit according to another embodiment of the present disclosure.

A pixel circuit is provided according to an embodiment of the present disclosure. Reference is made to FIG. 1 and FIG. 2, which are schematic structural diagrams of pixel circuits according to embodiments of the present disclosure. The pixel circuit includes an initializing device 200, a data writing device 300, a control device 100, and a current supplementing device 400.

Each control end of the initializing device 200, the data writing device 300, the control device 100, and the current supplementing device 400 is configured to receive a control signal.

The initializing device 200 further includes a first input end IN1. The data writing device 300 further includes a second input end IN2. The first input end IN1 is configured to receive a reference signal. The second input end IN2 is configured to receive a data signal.

The control device 100 further includes a first power input end CI1 and a first output end O1. The current supplementing device 400 further includes a second power input end CI2 and a second output end O2. The first power input end CI1 and the second power input end CI2 are both configured to receive an operating voltage. The first output end O1 is configured to output a first driving current. The second output end O2 is configured to output a second driving current.

A driving period of the pixel circuit includes a light-emitting phase.

In the light-emitting phase, the control signal is configure to control operation of the control device 100, so that the control device 100 generates the first driving current according to the data signal and the operating voltage. The first driving current is transmitted to a light-emitting unit D. The control signal is further configured to control operation of the current supplementing device 400, so that the current supplementing device 400 generates the second driving current according to the data signal and the operating voltage. The second driving current is transmitted to the light-emitting unit D. The light-emitting unit D is driven by the first driving current and the second driving current for light emission.

In FIG. 1 and FIG. 2, PVDD and PVEE represent two power signals, respectively, for the pixel circuits. PVDD is a positive power signal or a high-level power signal, and PVEE is a negative power signal or a low-level power signal. Vctrl represents the control signal, Vdata represents the data signal, and Vref represents the reference signal.

A main difference between FIGS. 1 and 2 lies in connection of an output end of the data writing device 300 and connection of the second output end O2 of the current supplementing device. In FIG. 1, the output end of the data writing device 300 is connected to the control device 100, and the data writing device 300 writes the data signal into the control device 100 in a data-writing process. In FIG. 2, the data writing device 300 is connected to the initializing device 200, and the data writing device 300 writes the data signal into the control device 100 via the initializing device 200 in a data-writing process.

In addition, the second output end of the current supplementing device 400 is connected to the control device 100 in FIG. 1, and is directly connected to an anode of the light-emitting unit D in FIG. 2. In each case, the second driving current generated by the current supplementing device 400 in the light-emitting phase flows into the anode of the light-emitting unit D eventually. That is, in FIG. 1, the second driving current generated by the current supplementing device 400 first flows into the control device 100, and then flows from the output end of the control device 100 into the anode of the light-emitting unit D together with the first driving current generated by the control device 100.

Generally, the control signal may include multiple sub-signals, and timing sequences of the sub-signals are usually different from each other. The control device 100, the data writing device 300, the current supplementing device 400, and the initializing device 200 may receive same or different sub-signals of the control signal. For example, both the current supplementing device 400 and the control device 100 need to operate in the light-emitting phase. Hence, the current supplementing device 400 and the control device 100 may receive a same sub-signal, so as to operate simultaneously during the light-emitting phase and generate the first driving current and the second driving current, respectively, which are transmitted to the light-emitting unit D. A relationship among the timing sequences of the sub-signals received by data writing device 300, the current supplementing device 400, the control device 100 and the initializing device 200 is not limited herein, which may depend on a practical situation.

In this embodiment, the current supplementing device 400 and the control device 100 provide the driving currents (i.e. the second driving current and the first driving current, respectively) simultaneously to the light-emitting unit D during the light-emitting phase. Thereby, the light-emitting unit D is driven by a combination of the first driving current and the second driving current for light emission, and a larger driving current can be provided for the light-emitting unit D in a case that each individual driving current is small (that is, the first driving current and the second driving current are both small). It is implemented that the control device 100 and the current supplementing device 400 are less likely to operate in the linear region, while a requirement of providing a large driving current to the light-emitting unit is met.

For example, assuming that the first driving current is identical to the second driving current, a driving current that the light-emitting unit D receives eventually for light emission is twice the first driving current or twice the second driving current. Thereby, the driving current that the light-emitting unit D receives eventually is large, while the first driving current generated by the control device 100 and the second driving current generated by the current supplementing device 400 are both small, namely, the currents flowing through the control device 100 and the current supplementing device 400 are both small. Thin film transistors in the control device 100 and the current supplementing device 400 are less likely to operate in the linear region due to a large current.

In a case that the sum of the first driving current and the second driving current still cannot meet a requirement on the driving current of the light-emitting unit D, the first driving current and the second driving current may be increased by reducing amplitude of the data signal. In a case that the first driving current generated by the control device 100 is equal to the second driving current generated by the current supplementing device 400, an increase of the driving current can be doubled when slightly reducing the amplitude of the data signal, in comparison with a pixel circuit in conventional technology (where increments of both the first driving current and the second driving current are equal to that of a driving circuit of the pixel circuit in conventional technology, when reducing the amplitude of the data signal). In such case, the control device 100 and the current supplementing device 400 are still less likely to operate in the linear region.

In conventional technology, besides reducing the amplitude of the data signal, the driving current flowing through the light-emitting unit D may be increased by reducing the PVEE. A decrease of the PVEE would increase a voltage difference between the PVDD and the PVEE, resulting in increased power consumption of the pixel circuit. Consequently, overall power consumption of the display panel is increased.

Hereinafter other phases of the driving period of the driving circuit are described. In one embodiment, the driving period further includes a first phase and a second phase.

In the first phase, the control signal is configured to control operation of the initializing device 200, so that the initializing device 200 resets the pixel circuit through the reference signal.

In the second phase, the control signal is configured to control operation of the data writing device 300, so that the data writing device 300 writes the data signal into the pixel circuit.

Alternatively, in the first phase, the control signal is configured to control operation of both the initializing device 200 and the data writing device 300, so that the initializing device 200 resets the pixel circuit through the reference signal, and the data writing device 300 writes the data signal into the pixel circuit.

Alternatively, in the second phase, the control signal is configure to perform threshold compensation on the initializing device 200.

In the first phase and the second phase, functions performed by the initializing device 200 and the data writing device 300 depend on specific circuit structures.

For some pixel circuits, it is only necessary to reset the pixel circuit and write the data signal in the first phase and the second phase. For other pixel circuits, the pixel circuit is further required to perform threshold compensation besides resetting the pixel circuit and writing the data signal in the first phase and the second phase. The functions are not limited herein, which depends on a practical situation.

Figure 3:
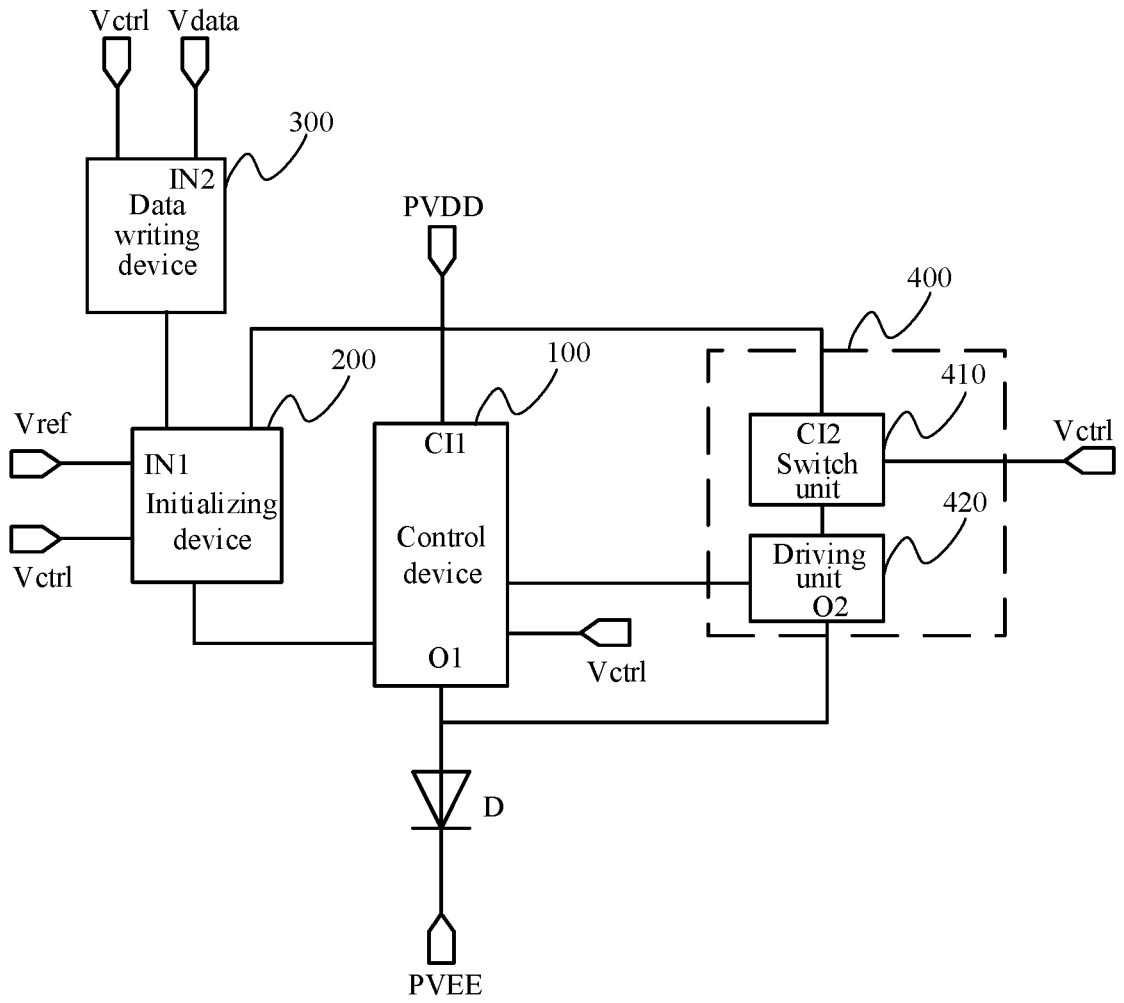
FIG. 3 is a schematic structural diagram of a pixel circuit according to another embodiment of the present disclosure.

A specific structure of the current supplementing device 400 may refer to FIG. 3, which is a schematic structural diagram of the pixel circuit according to another embodiment of the present disclosure. The current supplementing device 400 includes a switch unit 410 and a driving unit 420.

The driving unit 420 is biased to a first operation state based on the data signal, in the second phase or the light-emitting phase.

The switch unit 410 is turned on based on the control signal, in the light-emitting phase, so that the driving unit 420 in the first operation state generates the second driving current based on the operating voltage.

In this embodiment, the switch unit 410 is configured to receive the control signal, and the driving unit 420 is connected to the control device 100. In the driving period of the pixel circuit, the driving unit 420 is biased to the first operation state in the second phase or light-emitting phase, by the data signal written into the pixel circuit. The first operation state may refer to a saturation mode of a thin film transistor. In the light-emitting phase, the switch unit 410 is turned on under control of the control signal, so that a path is formed through the switch unit 410 and the driving unit 420. Thereby, the driving unit 420 receives the power signal PVDD, and generates the second driving current for output.

Figure 4:
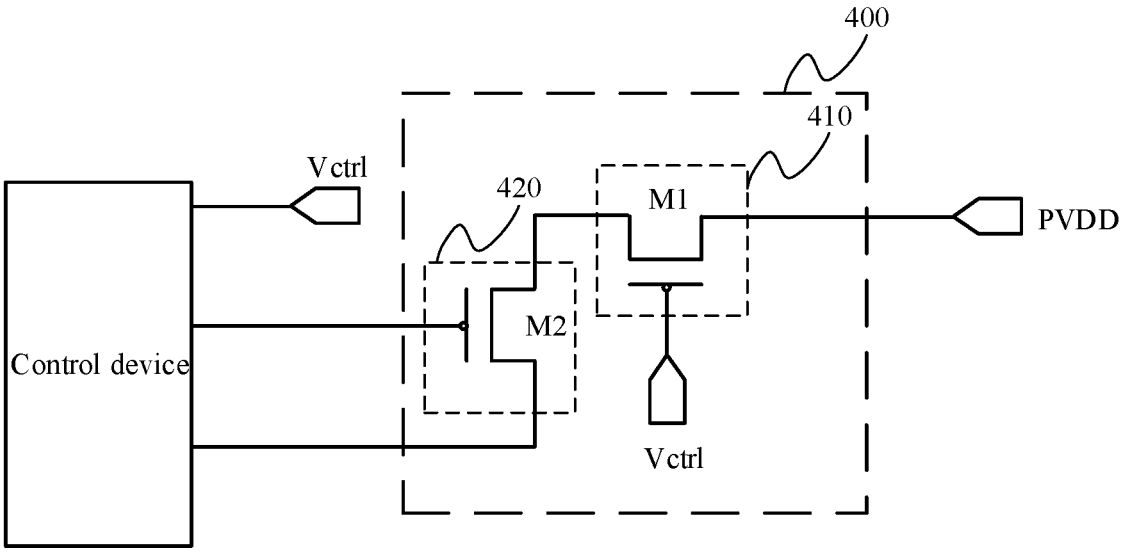
FIG. 4 is a schematic structural diagram of a pixel circuit according to another embodiment of the present disclosure.
Figure 5:
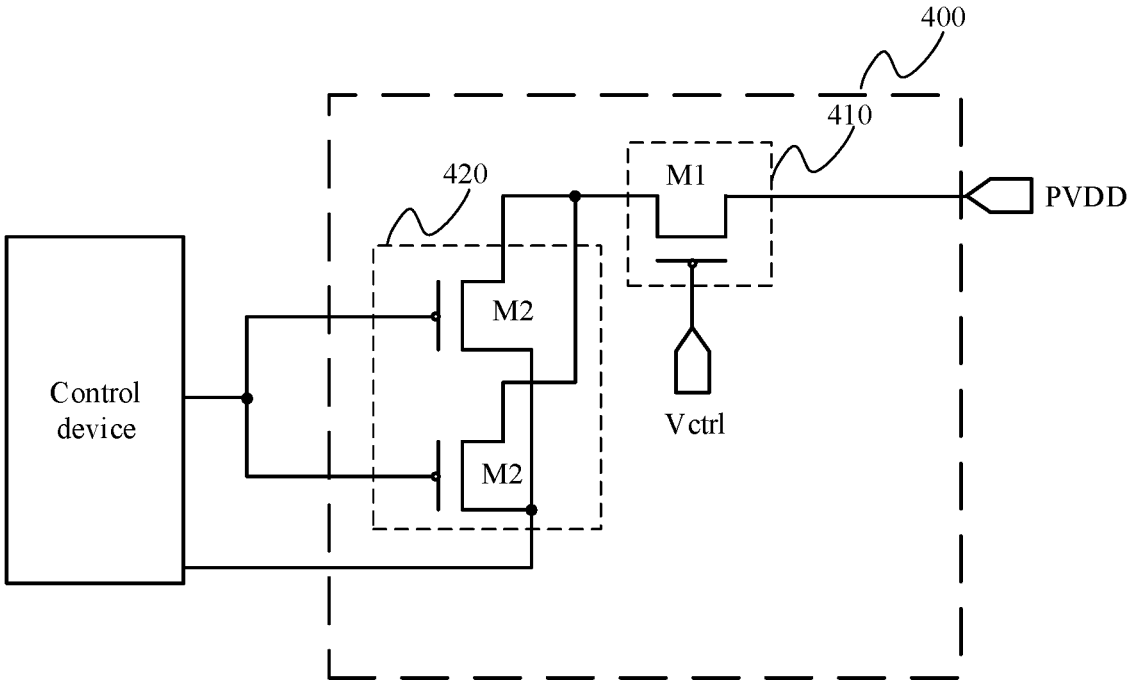
FIG. 5 is a schematic structural diagram of a pixel circuit according to another embodiment of the present disclosure.

Hereinafter described are feasible structures of the switch unit and the driving unit. Reference is made to FIGS. 4 and 5, which are schematic structural diagrams of the pixel circuit according to embodiments of the present disclosure. In FIG. 4, the switch unit 410 includes a first transistor M1, and the driving unit 420 includes at least one second transistor M2. A control terminal of the first transistor M1 is configured to receive the control signal, and the first transistor M1 is connected in series with the driving unit. That is, the second terminal of the first transistor M1 is electrically connected to an input end of the driving unit 420, and the second terminal of the second transistor M2 is electrically connected to the anode of the light-emitting unit D. Or, the first terminal of the first transistor M1 is configured to receive the power signal PVDD, and the second terminal of the first transistor M1 is electrically connected to the input end of the driving unit 420.

The driving unit 420 includes at least one second transistor M2. In FIG. 4, a quantity of the second transistor M2 is one. In FIG. 5, there are multiple second transistors M2. The second transistor M2 is biased to a second operation state based on the data signal, in the second phase or the light-emitting phase.

Reference is further made to FIG. 5. In a case that there are multiple second transistors M2, the multiple second transistors M2 are connected in parallel, and multiple branch currents are simultaneously generated during operation of the multiple second transistors M2. The branch currents converge to form the second driving current, facilitating increasing amplitude of the second driving current. It is taken as an example that there are two second transistors M2, as shown in FIG. 5. Control terminals of the two second transistors M2 are both electrically connected to the control device 100, first terminals of the two second transistors M2 are both electrically connected to the second terminal of the first transistor M1, and the second terminals of the two second transistors M2 are both electrically connected together to the control device 100 or an anode of the light-emitting unit D. The second terminals of the two second transistors M2 serve together as the second output end O2.

Hereinafter illustrated are specific sub-signals included in the control signal and feasible structures of other devices of the pixel circuit.

Figure 6:
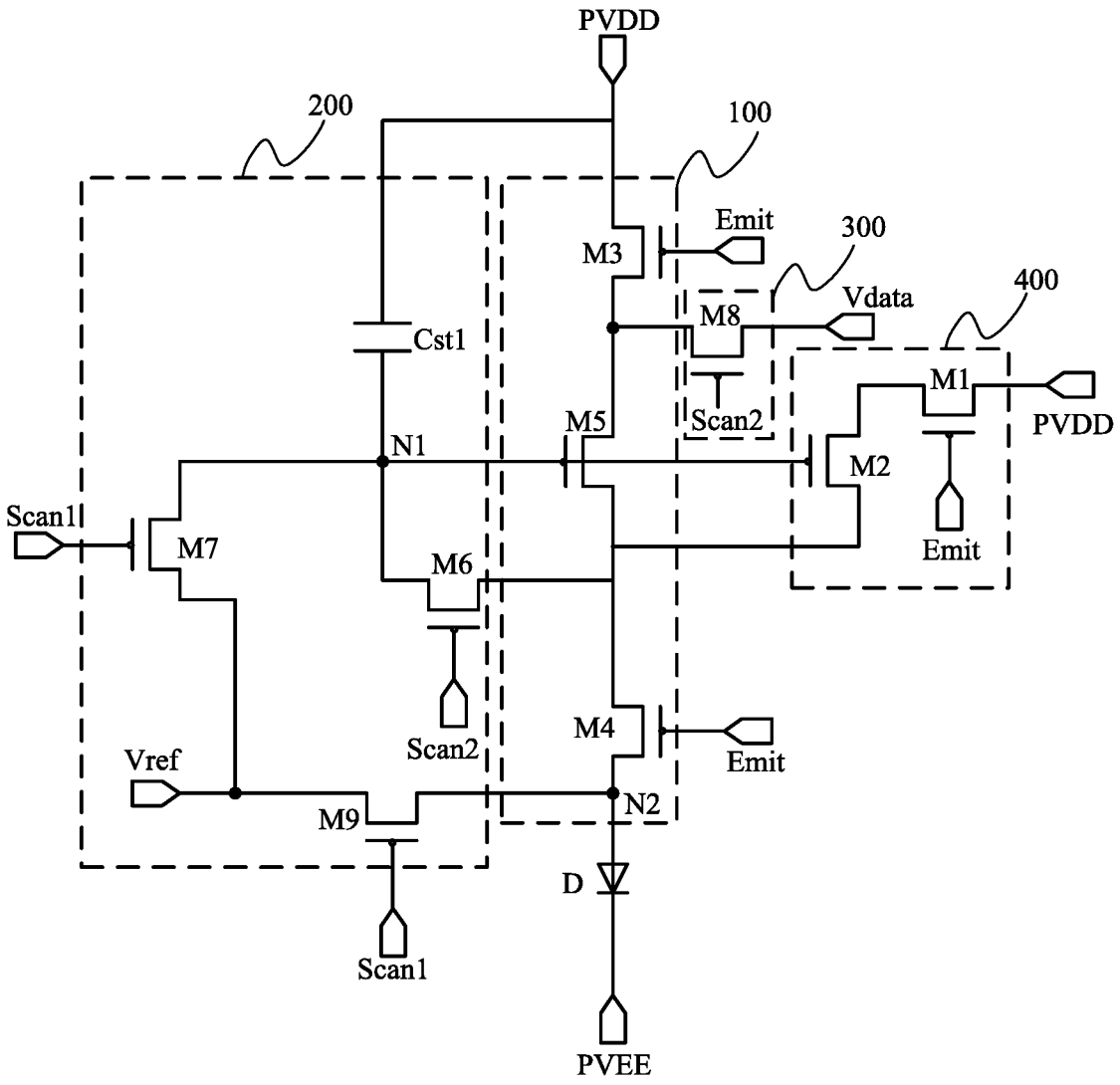
FIG. 6 is a schematic structural diagram of a pixel circuit according to another embodiment of the present disclosure.

Reference is made to FIG. 6, which is a schematic structural diagram of the pixel circuit according to another embodiment of the present disclosure. The control signal includes a first control signal, a second control signal, and a third control signal.

The initializing device 200 further includes a first control end and a second control end.

The data writing device 300 further includes a third control end.

The first control signal is inputted into the initializing device 200 via the first control end, and is configured to control the initializing device 200 to reset the pixel circuit through the reference signal in the first phase.

The second control signal is inputted into the initializing device 200 via the second control end, and is inputted into the data writing device 300 via the third control end. The second control signal is configured to control the data writing device 300 and the initializing device 200 to write the data signal into the pixel circuit in the second phase.

The third control signal is configured to control operation of the control device 100 in the light-emitting phase, so that the control device 100 generates the first driving current according to the data signal and the operating voltage. The third control signal is further configured to control operation of the current supplementing device 400 in the light-emitting phase, so that the current supplementing device 400 generates the second driving current according to the data signal and the operating voltage.

In FIG. 6, the first control signal is denoted by Scan1, the second control signal is denoted by Scan2, and the third control signal is denoted by Emit.

Reference is further made to FIG. 6. The control device includes a first control unit and a second control unit.

The first control unit is biased to a third operation state based on the data signal, in the second phase.

The second control unit is turned on based on the third control signal during the light-emitting phase, so that the first control unit in the third operation state generates the first driving current according to the operating voltage.

The first control unit includes a fifth transistor M5.

The second control unit includes a third transistor M3 and a fourth transistor M4.

A first terminal of the third transistor M3 is configured to receive the operating voltage, a second terminal of the third transistor M3 is electrically connected to a first terminal of the fifth transistor M5, a second terminal of the fifth transistor M5 is electrically connected to a first terminal of the fourth transistor M4, and a second terminal of the fourth transistor M4 is electrically connected to the anode of the light-emitting unit D.

Control terminals of the third transistor M3 and the fourth transistor M4 are configured to receive the third control signal.

A control terminal of the fifth transistor M5 is electrically connected to the initializing device 200.

The data writing device 300 includes an eighth transistor M8.

The initializing device 200 includes a first capacitor Cst1, a sixth transistor M6, a seventh transistor M7, and a ninth transistor M9.

A control terminal of the sixth transistor M6 and a control terminal of the eighth transistor M8 are configured to receive the second control signal. A control terminal of the seventh transistor M7 and a control terminal of the ninth transistor M9 are configured to receive the first control signal.

A first terminal of the eighth transistor M8 is configured to receive the data signal. A second terminal of the eighth transistor M8 is electrically connected to a common node between the third transistor M3 and the fifth transistor M5.

A first terminal of the sixth transistor M6 is electrically connected to a terminal of the first capacitor Cst1, the control terminal of the fifth transistor M5, and a second terminal of the seventh transistor M7. Another terminal of the first capacitor Cst1 is electrically connected to a terminal of the third transistor M3 away from the fifth transistor M5. A second terminal of the sixth transistor M6 is electrically connected to a common node between the fifth transistor M5 and the fourth transistor M4.

A first terminal of the seventh transistor M7 and a first terminal of the ninth transistor M9 are both configured to receive the reference signal.

A second terminal of the ninth transistor M9 is electrically connected to a common node between the fourth transistor M4 and the light-emitting unit D.

Figure 7:
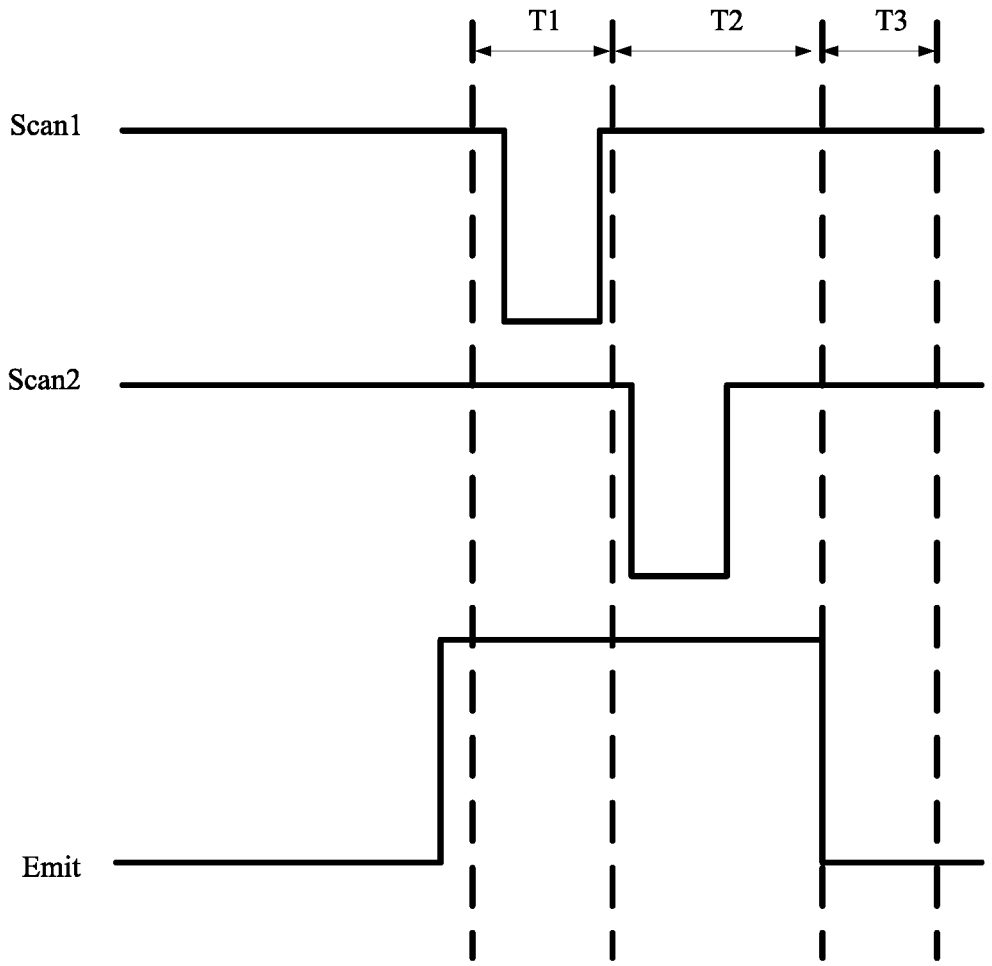
FIG. 7 is a schematic timing sequence of a first control signal, a second control signal, and a third control signal according to an embodiment of the present disclosure.

In FIG. 6, it is taken as an example for illustration that the first transistor M1 to the ninth transistor M9 are all P-channel thin film transistors. In another embodiment of the present disclosure, the first transistor M1 to the ninth transistor M9 may all be N-channel thin film transistors. A type of the thin film transistors is not limited herein. In this embodiment, reference is made to FIG. 7, which is a schematic timing sequence of the first control signal, the second control signal and the third control signal. Hereinafter a working process of the pixel circuit is briefly described. In the first phase T1, the first control signal Scan1 is at a low level, and the second control signal Scan2 and third control signal Emit are at a high level. The seventh transistor M7 and the ninth transistor M9 are turned on, and the reference signal is written to nodes N1 and N2 so as to reset the nodes N1 and N2. At such time, voltages at both the nodes N1 and N2 follow the reference signal.

In the second phase T2, the first control signal Scan1 is at a high level, the second control signal Scan2 is at a low level, and the third control signal Emit is at a high level. The fifth transistor M5, the sixth transistor M6, and the eighth transistor M8 are turned on, and operate together like a diode. The data signal is written to the fifth transistor M5. At such time, a voltage at node N1 is equal to a difference between Vdata and an absolute value of a threshold voltage of the fifth transistor M5, i.e. equal to Vdata−|Vth|, where |Vth| represents the absolute value of the threshold voltage of the fifth transistor M5.

In the light-emitting phase T3, the first control signal Scan1 and the second control signal Scan2 are at a high level, and the third control signal Emit is at a low level. The third transistor M3, the fifth transistor M5, and the fourth transistor M4 are turned on, and the fifth transistor M5 generates the first driving current. At the same time, the first transistor M1 and the second transistor M2 are turned on, and the second transistor M2 generates the second driving current. The first driving current and the second driving current flow through the fourth transistor M4 that is turned on, and drive the light-emitting unit D for light emission. At such time, a voltage at the node N1 is still Vdata−|Vth|, and the first driving current is expressed as follows.

$$Id=k(Vsg-Vth)^2=k[\mathrm{PVDD}-(V\mathrm{data}-|Vth|)-|Vth|]^2=k(\mathrm{PVDD}-V\mathrm{data})^2$$

Id represents the first driving current, Vsg represents a source-to-gate voltage of the fifth transistor M5, and PVDD represents the operating voltage. The expression of the first driving current shows that an increase in the current flowing through the light-emitting unit usually requires a decrease in amplitude of the data signal, in a case that the light-emitting unit is solely driven by the first driving current for light emission. Such mechanism may cause the fifth transistor M5 to operate in the linear region. For example, it is assumed that the threshold voltage Vth of the fifth transistor is −2V, the data voltage Vdata is 3V, and a voltage at the anode of the light-emitting unit is 1V during light emission. In such case, the voltage VN1 at the node N1 is 1V. At this time, the gate-to-drain voltage Vgd is 0V, and thereby the fifth transistor is in a saturation mode.

The voltage at the anode increases as Vdata decreases, in a case that the first driving current is increased by reducing the data voltage Vdata, so as to enhance the current flowing through the light-emitting unit. It is assumed that the voltage at the anode of the light-emitting unit is increased to 2V when the data signal Vdata is decreased to 1V. In such case, the voltage VN1 of the node N1 is −1V, and the gate-to-drain voltage Vgd of the fifth transistor is −3V, which is smaller than Vth. At this time, the fifth transistor M5 operates in the linear region, and the capability to control the first driving current is weakened.

In this embodiment, the second driving current generated by the second transistor M2 converges with the first driving current, to drive the light-emitting unit together. Reference is further made to FIG. 6. In a case that a quantity of the second transistor M2 is one and the second transistor M2 is identical to the fifth transistor M5, the second driving current is equal to the first driving current. The current driving the light-emitting unit is a sum of the first driving current and the second driving current, and the requirement of the light-emitting unit on a large driving current is better satisfied. Even if the requirement of the light-emitting unit is still not met when the first driving current and the second driving current drive the light-emitting unit together, amplitude of the first driving current and the second driving current can be simultaneously increased by reducing amplitude of the data signal. It is assumed that in conventional technology, amplitude of a current of the data signal needs to be reduced by ΔI to meet the requirement of the light-emitting unit on the driving current. In this embodiment, it is only required to reduce the amplitude of current of the data signal by ΔI/2 to meet the requirement of the light-emitting unit on the driving current. Therefore, a risk of the second transistor M2 and the fifth transistor M5 operating in the linear region is effectively reduced.

In FIG. 6, the second transistor M2 and the fifth transistor M5 are simultaneously biased by the voltage at the node N1. In the light-emitting phase, the first terminals of the second transistor M2 and the fifth transistor M5 are both configured to receive the power signal PVDD, and the second terminals of the second transistor M2 and the fifth transistor M5 are electrically connected with each other. That is, during operation, the second transistor M2 and the fifth transistor M5 are identical in states of the terminals. The second transistor M2 and the fifth transistor M5 may be identical in type and size. In such case, the first driving current may be exactly equal to the second driving current, in a case that there is only one second transistor M2 in the current supplementing device 400; and the second driving current is N times the first driving current, in a case there are N second transistors M2 in the current supplementing device 400, where N≥2.

Figure 8:
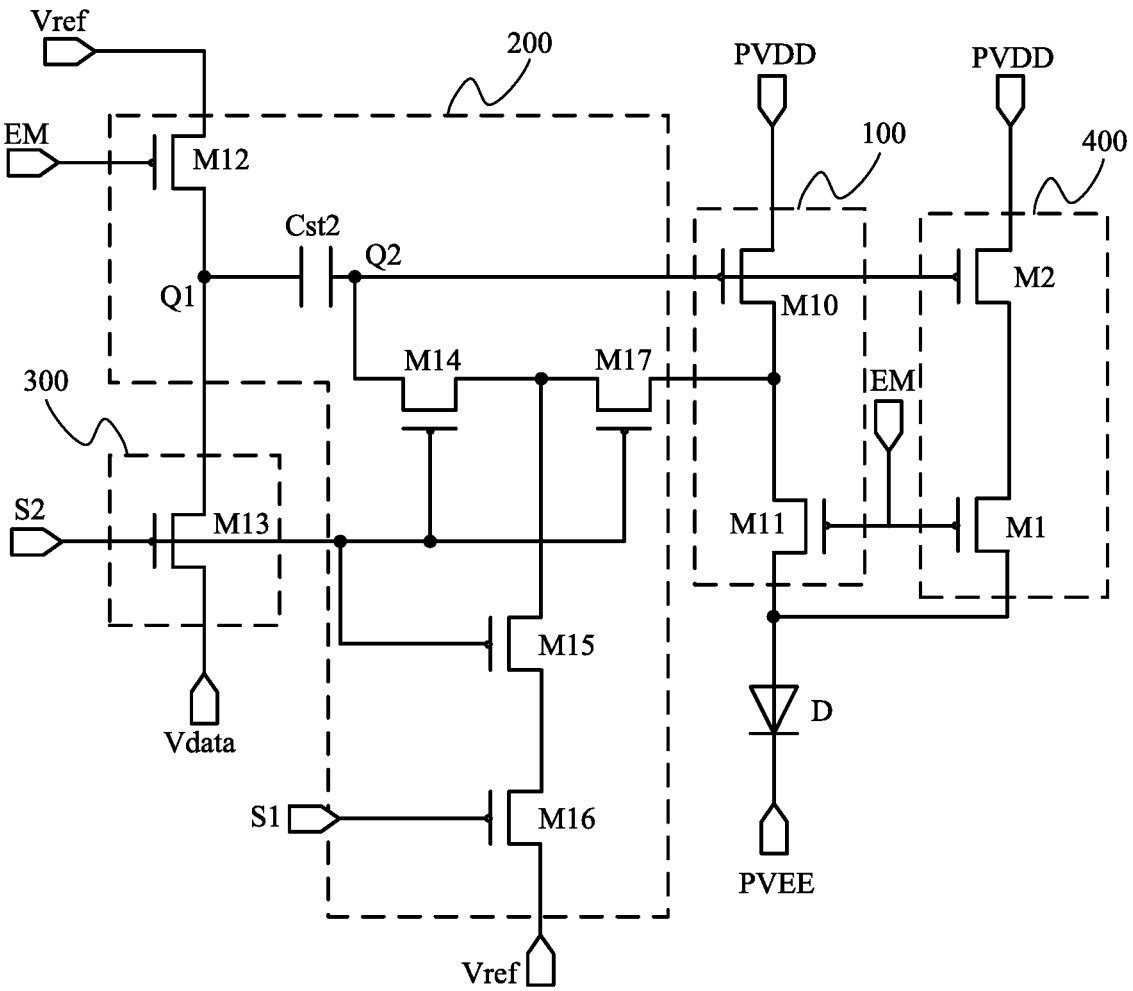
FIG. 8 is a schematic structural diagram of a pixel circuit according to another embodiment of the present disclosure.

Reference is made to FIG. 8, which is a schematic structural diagram of a pixel circuit according to another embodiment of the present disclosure. The control signal includes a fourth control signal, a fifth control signal, and a sixth control signal.

The initializing device 200 further includes a fourth control end and a fifth control end.

The data writing device 300 further includes a sixth control end.

The fourth control signal is inputted into the initializing device 200 via the fourth control end.

The fifth control signal is inputted into the data writing device 300 via the sixth control end.

The sixth control signal is inputted into the control device 100 and the current supplementing device 400, and is further inputted into the initializing device 200 via the fifth control end.

In the first phase, the fourth control signal is configured to control the control device 100 to reset the pixel circuit through the reference signal. The fifth control signal is configured to control the data writing device 300 to write the data signal into the pixel circuit.

In the second phase, the fifth control signal is configured to perform threshold compensation on the initializing device 200.

In the light-emitting phase, the sixth control signal is configured to control the control device 100 to generate the first driving current according to the data signal and the operating voltage. The first driving current is transmitted to the light-emitting unit D. The sixth control signal is further configured to control the current supplementing device 400 to generate the second driving current according to the data signal and the operating voltage. The second driving current is transmitted to the light-emitting unit D.

In FIG. 8, the fourth control signal is denoted by S1, the fifth control signal is denoted by S2, and the sixth control signal is denoted by EM.

Reference is further made to FIG. 8. The control device 100 includes a tenth transistor M10 and an eleventh transistor M11.

A control terminal of the tenth transistor M10 is electrically connected to the initializing device 200. A control terminal of the eleventh transistor M11 is electrically connected to the switch unit, and is configure to receive the sixth control signal.

A first terminal of the tenth transistor M10 is configured to receive the operating voltage, a second terminal of the tenth transistor M10 is electrically connected to a first terminal of the eleventh transistor M11, and a second terminal of the eleventh transistor M11 is electrically connected to the anode of the light-emitting unit D.

The data writing device 300 includes a thirteenth transistor M13.

The initializing device 200 includes a second capacitor Cst2, a twelfth transistor M12, a fourteenth transistor M14, a fifteenth transistor M15, a sixteenth transistor M16, and a seventeenth transistor M17.

A control terminal of the twelfth transistor M12 is configured to receive the sixth control signal, a first terminal of the twelfth transistor M12 is configured to receive the reference signal, and a second terminal of the twelfth transistor M12 is electrically connected to a terminal of the second capacitor Cst2 and a second terminal of the thirteenth transistor M13. Another terminal of the second capacitor Cst2 is electrically connected to a first terminal of the fourteenth transistor M14 and the control terminal of the tenth transistor M10.

A control terminal of the thirteenth transistor M13 is configured to receive the fifth control signal, and a first terminal of the thirteenth transistor M13 is configured to receive the data signal.

A control terminal of the fourteenth transistor M14, a control terminal of the seventeenth transistor M17, and a control terminal of the fifteenth transistor M15 are all configured to receive the fifth control signal. A second terminal of the fourteenth transistor M14 is electrically connected to a first terminal of the seventeenth transistor M17 and a second terminal of the fifteenth transistor M15. A second terminal of the seventeenth transistor M17 is electrically connected to a common node between the tenth transistor M10 and the eleventh transistor M11. A first terminal of the fifteenth transistor M15 is electrically connected to a second terminal of the sixteenth transistor M16, a first terminal of the sixteenth transistor M16 is configured to receive the reference signal, and a control terminal of the sixteenth transistor M16 is configured to receive the sixth control signal.

In FIG. 8, it is taken as an example for illustration that the tenth transistor M10 to the seventeenth transistor M17 are all P-channel thin film transistors. In another embodiment of the present disclosure, the tenth transistor M10 to the seventeenth transistor M17 may all be N-channel thin film transistors. A type of the thin film transistors is not limited herein.

Figure 9:
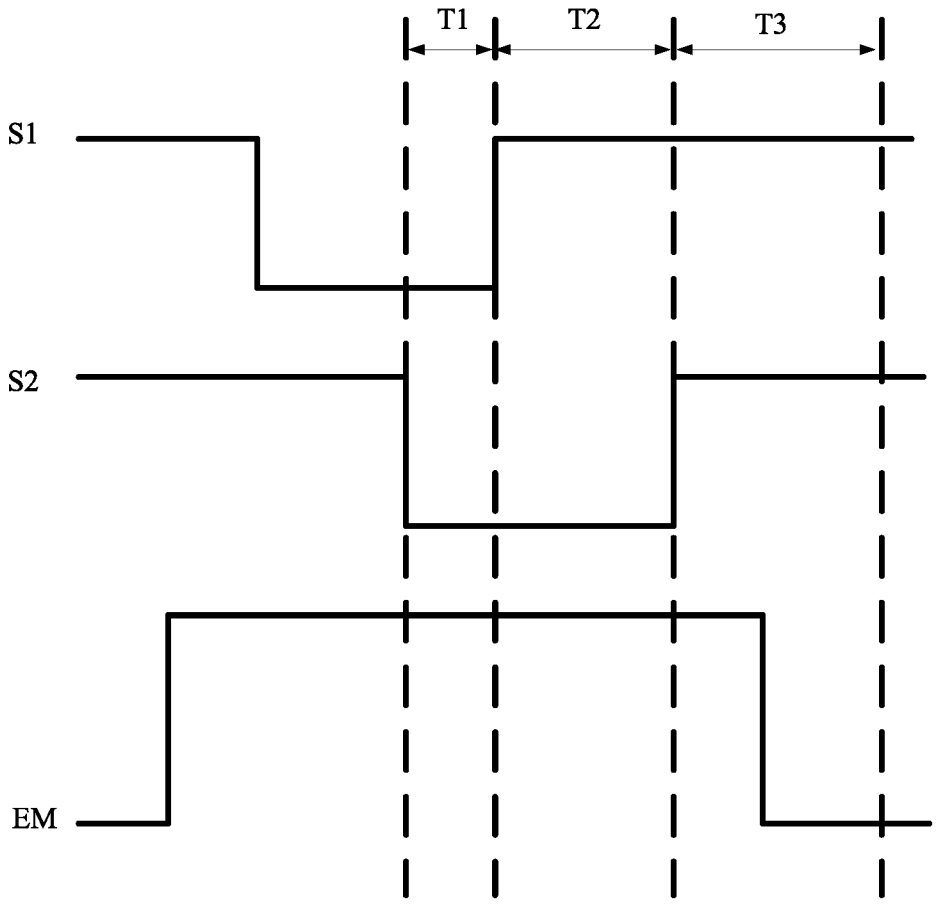
FIG. 9 is a schematic timing sequence of a fourth control signal, a fifth control signal, and a sixth control signal according to an embodiment of the present disclosure.

Reference is made to FIG. 9, which is a schematic timing sequence of the fourth control signal, the fifth control signal, and the sixth control signal. Hereinafter a working process of the pixel circuit is briefly described. In the first phase T1, the fourth control signal S1 and the fifth control signal S2 are both at a low level, the sixth control signal EM is at a high level. The thirteenth transistor M13, the sixteenth transistor M16, the fifteenth transistor M15, the fourteenth transistor M14, and the seventeenth transistor M17 are turned on. The data signal is written to node Q1, that is, a voltage at the node Q1 follows the data signal, Vdata. The reference signal is written to node Q2, that is, a voltage at the node Q2 follows the reference signal, Vref.

In the second phase T2, the fourth control signal S1 and the sixth control signal EM are at a high level, and the fifth control signal S2 is at a low level. The sixteenth transistor M16 is turned from an on-state to an off-state. The thirteenth transistor M13, the fourteenth transistor M14, the fifteenth transistor M15 and the seventeenth transistor M17 are kept in an on-state. At this time, the voltage at the node Q1 still follows the data signal, i.e. VQ1=Vdata, and the voltage at the node Q2 follows a difference between the power signal PVDD and an absolute value of a threshold voltage of the tenth thin film transistor M10, that is, VQ2=PVDD−|Vth|. Thereby, the threshold compensation is achieved In the light-emitting phase T3, the fourth control signal S1 and the fifth control signal S2 are both at a high level, and the sixth control signal EM is at a low level. The tenth transistor M10, the eleventh transistor M11, the first transistor M1, and the second transistor M2 are turned on. The tenth transistor M10 generates the first driving current, and the second transistor M2 generates the second driving current. The first driving current and the second driving current drive the light-emitting unit D together for light emission. At this time, the voltage VQ1 of the node Q1 is equal to Vref, and a change in the voltage of the node Q1 is equal to Vref-Vdata. Thereby, the potential of the node Q2 is equal to PVDD−|Vth|+Vref-Vdata.

Correspondingly, the first drive current may be expressed as follows.

$$Id=k(Vsg-Vth)^2=k[\mathrm{PVDD}-\mathrm{PVDD}+|Vth|-V\mathrm{ref}+V\mathrm{data}-|Vth|)-|Vth|]^2=k(\mathrm{PVDD}-V\mathrm{data})^2$$

Id represents the first driving current, and Vsg represents a source-to-gate voltage of the tenth transistor M10. The pixel circuit illustrated in FIG. 8 is different from the pixel circuit illustrated in FIG. 6. In this embodiment, the Vdata is generally greater than the Vref for a PMOS transistor. An increase in the data signal Vdata would lead to a higher downward coupling at the node Q1 and thereby a larger first driving current, when the sixth control signal EM is turned to be the low level in the light-emitting phase T3. For a requirement on a large current, amplitude of the data signal Vdata needs to be set high, and amplitude of the reference signal Vref needs to be set low. Similar to the foregoing embodiment, a lower voltage at the node Q2 would result in a higher risk of the tenth transistor M10 operating in the linear region.

In FIG. 8, the tenth transistor M10 and the second transistor M2 are simultaneously biased by the voltage at the node Q2. In the light-emitting phase, the first terminals of the tenth transistor M10 and the second transistor M2 are both configured to receive the power signal PVDD, and the second terminals of the second transistor M2 and the tenth transistor M10 are both electrically connected to the anode of the light-emitting unit D through a conductive P-channel thin film transistor. That is, during operation, the tenth transistor M10 and the second transistor M2 are completely identical in states of the terminals. The second transistor M2 and the tenth transistor M10 may be same in type and size. In such case, the first driving current may be exactly equal to the second driving current, in a case that there is only one second transistor M2 in the current supplementing device 400; and the second driving current is N times the first driving current, in a case there are N second transistors M2 in the current supplementing device 400, where N≥2.

Figure 10:
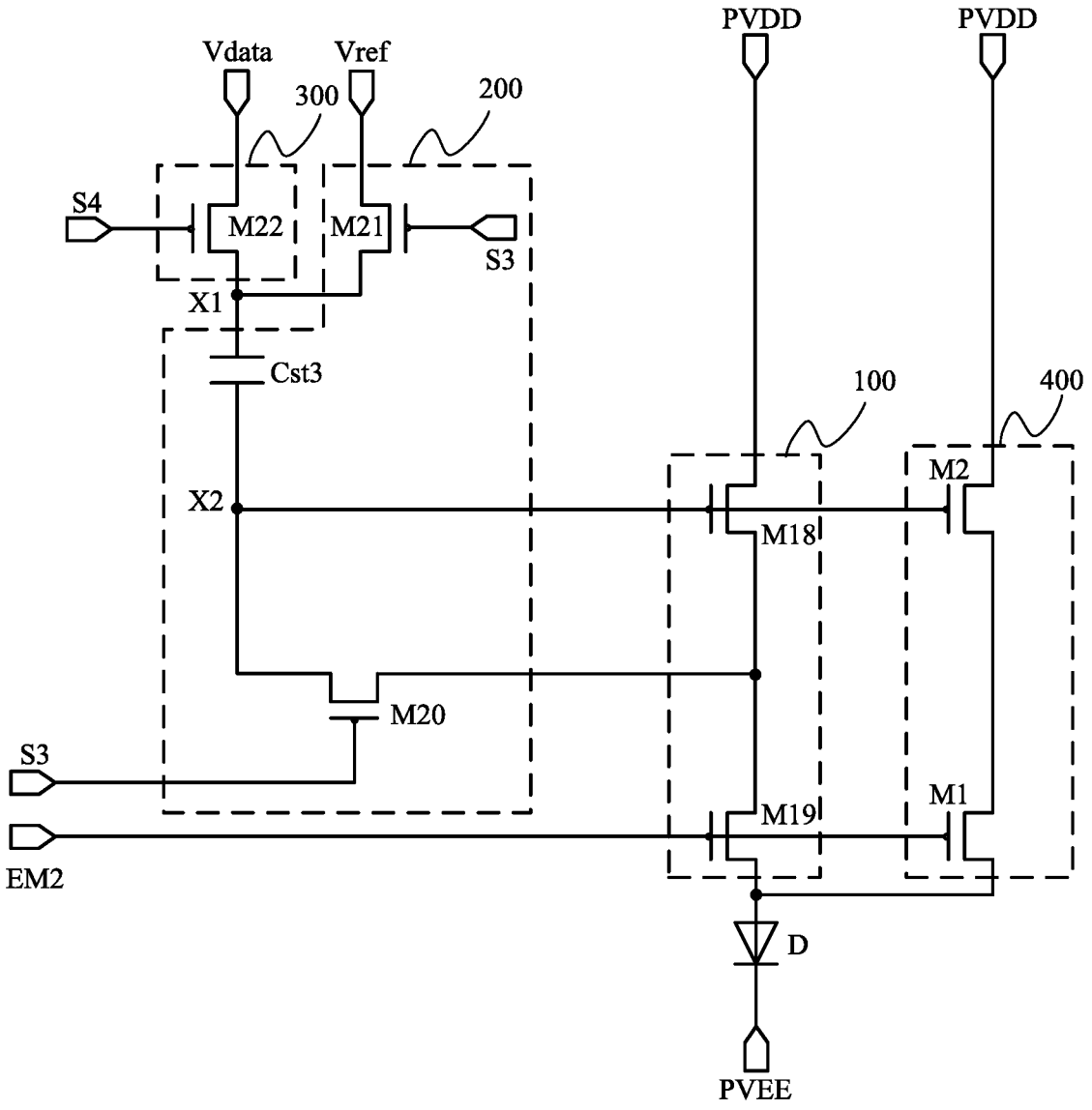
FIG. 10 is a schematic structural diagram of a pixel circuit according to another embodiment of the present disclosure.

Reference is made to FIG. 10, which is a schematic structural diagram of a pixel circuit according to another embodiment of the present disclosure. The control signal includes a seventh control signal, an eighth control signal, and a ninth control signal.

The data writing device 300 further includes an eighth control end.

The initializing device 200 further includes a seventh control end.

The seventh control signal is inputted into the control device 100 and the current supplementing device 400.

The eighth control signal is inputted into the initializing device 200 via the seventh control end.

The ninth control signal is inputted into the data writing device 300 via the eighth control end.

In the first phase, the eighth control signal is configured to control the initializing device 200 to reset the pixel circuit through the reference signal.

In the second phase, the ninth control signal is configured to control the data writing device 300 to write the data signal into the pixel circuit.

In the light-emitting phase, the seventh control signal is configured to control the control device 100 to generate the first driving current according to the data signal and the operating voltage, and control the current supplementing device 400 to generate the second driving current according to the data signal and the operating voltage.

In FIG. 10, the eighth control signal is denoted by S3, the ninth control signal is denoted by S4, and the seventh control signal is denoted by EM2.

Reference is further made to FIG. 10. The control device 100 includes an eighteenth transistor M18 and a nineteenth transistor M19.

A control terminal of the eighteenth transistor M18 is electrically connected to the initializing device 200. A control terminal of the nineteenth transistor M19 is electrically connected to the current supplementing device 400, and is configured to receive the seventh control signal.

A first terminal of the eighteenth transistor M18 is configured to receive the operating voltage, a second terminal of the eighteenth transistor M18 is electrically connected to a first terminal of the nineteenth transistor M19, and a second terminal of the nineteenth transistor M19 is electrically connected to an anode of the light-emitting unit D.

The initializing device 200 includes a third capacitor Cst3, a twentieth transistor M20, and a twenty-first transistor M21.

The data writing device 300 includes a twenty-second transistor M22.

A control terminal of the twentieth transistor M20 is configured to receive the eighth control signal. A first terminal of the twentieth transistor M20 is electrically connected to a terminal of the third capacitor Cst3 and the control terminal of the eighteenth transistor M18. A second terminal of the twentieth transistor M20 is electrically connected to the second terminal of the eighteenth transistor M18 and the first terminal of the nineteenth transistor M19.

A control terminal of the twenty-second transistor M22 is configured to receive the ninth control signal, a first terminal of the twenty-second transistor M22 is configured to receive the data signal, and a second terminal of the twenty-second transistor M22 is electrically connected to a second terminal of the twenty-first transistor M21 and another terminal of the third capacitor Cst3.

A control terminal of the twenty-first transistor M21 is configured to receive the eighth control signal, and a first terminal of the twenty-first transistor M21 is configured to receive the reference signal.

In FIG. 10, it is taken as an example for illustration that the eighteenth transistor M18 to the twenty-second transistor M22 are P-channel thin film transistors. In another embodiment of the present disclosure, the eighteenth transistor M18 to the twenty-second transistor M22 may all be N-channel thin film transistors. A type of the thin film transistors is not limited herein.

Figure 11:
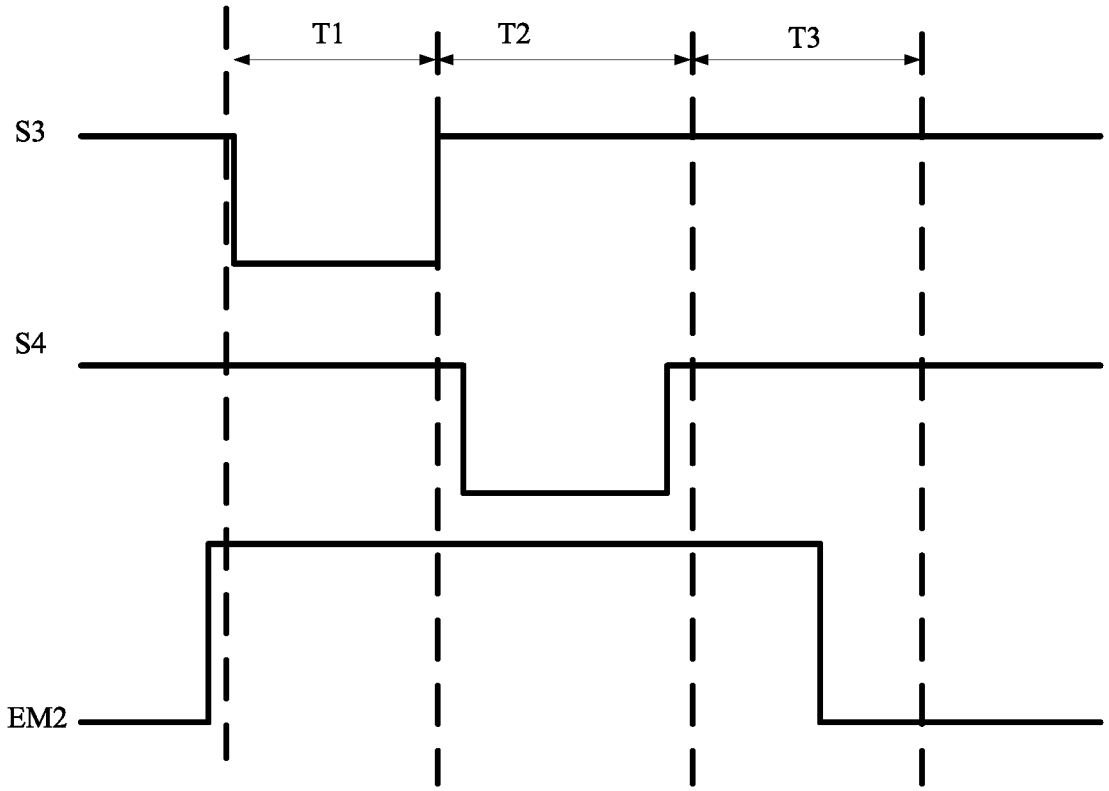
FIG. 11 is a schematic timing sequence of a seventh control signal, an eighth control signal, and a ninth control signal according to an embodiment of the present disclosure.

Reference is made to FIG. 11, which is a schematic timing sequence of the seventh control signal EM2, the eighth control signal S3, and the ninth control signal S4. Hereinafter a working process of the pixel circuit is briefly described. In the first phase T1, the eighth control signal S3 is at a low level, the seventh control signal EM2 and the ninth control signal S4 are both at a high level. At this time, the twentieth transistor M20 and the twenty-first transistor M21 are turned on, and the reference signal is written into node X1, i.e. VX1=Vref. A voltage at node X2 follows a difference between the power supply signal PVDD and an absolute value of a threshold voltage of the eighteenth thin film transistor M18, that is, VX2=PVDD−|Vth|.

In the second phase T2, the ninth control signal S4 is at a low level, and the seventh control signal EM2 and the eighth control signal S3 are both at a high level. At this time, the twenty-second transistor M22 is turned on, and the data signal is written to the node X1, i.e. VX1=Vdata. A change in the voltage of the node X1 is a difference between the data signal and the reference signal, i.e. Vdata-Vref. Thereby, the voltage of the node X2 becomes a sum of the change in the voltage of the node X1 and the difference between the power signal PVDD and the absolute value of the threshold voltage of the eighteenth thin film transistor M18, i.e. VX2=PVDD−|Vth|+ΔV. ΔV is the change in the voltage of the node X1, and |Vth| is the threshold voltage of the eighteenth thin film transistor M18.

In the light-emitting phase, the seventh control signal EM2 is at a low level, the eighth control signal S3 and the ninth control signal S4 are both at a high level. At this time, the second transistor M2, the first transistor M1, the eighteenth transistor M18, and the nineteen transistors M19 are all turned on. The second transistor M2 generates the second driving current, and the eighteenth transistor M18 generates the first driving current. The first driving current and the second driving current drive the light-emitting unit D together for light emission. The first drive current may be expressed as follows $$Id=k(Vsg-Vth)^2=k(\mathrm{PVDD}-\mathrm{PVDD}+|Vth|-V\mathrm{data}+V\mathrm{ref}-|Vth|)^2=k(V\mathrm{ref}-V\mathrm{data})^2$$

Vsg represents a source-to-gate voltage of the eighteenth transistor M18, and |Vth| represents the threshold voltage of the eighteenth transistor M18. In this embodiment, the Vdata is generally smaller than the Vref for a PMOS transistor. The expression of the first driving current shows that an increase in the current flowing through the light-emitting unit usually requires a decrease in amplitude of the data signal, in a case that the light-emitting unit is solely driven by the first driving current for light emission. Similar to the pixel circuit illustrated in FIG. 6, such mechanism may cause the eighteenth transistor M18 to operate in the linear region.

In this embodiment, the second driving current generated by the second transistor M2 converges with the first driving current, to drive the light-emitting unit together. Reference is further made to FIG. 10. In a case that a quantity of the second transistor M2 is one and the second transistor M2 is identical the eighteenth transistor M18, the second driving current is equal to the first driving current. The current driving the light-emitting unit is a sum of the first driving current and the second driving current, and the requirement of the light-emitting unit on a large driving current is better satisfied. Even if the requirement of the light-emitting unit is still not met when the first driving current and the second driving current drive the light-emitting unit together, amplitude of the first driving current and the second driving current can be simultaneously increased by reducing amplitude of the data signal. It is assumed that in conventional technology, the amplitude of the data signal needs to be reduced by $\Delta I$ to meet the requirement of the light-emitting unit on the driving current. In this embodiment, it is only required to reduce the amplitude of the data signal by $\Delta I/2$ to meet the requirement of the light-emitting unit on the driving current. Therefore, a risk of the second transistor M2 and the eighteenth transistor M18 operating in the linear region is effectively reduced.

In FIG. 10, the second transistor M2 and the eighteenth transistor M18 are simultaneously biased by the voltage at the node X2. In the light-emitting phase, the first terminals of the second transistor M2 and the eighteenth transistor M18 are both configured to receive the power signal PVDD, and the second terminals of the second transistor M2 and the eighteenth transistor M18 are both electrically connected to the anode of the light-emitting unit D via a P-channel thin film transistor that is turned on. That is, during operation, the second transistor M2 and the eighteenth transistor M18 are identical in states of the terminals. The second transistor M2 and the eighteenth transistor M18 may be identical in type and size. In such case, the first driving current may be exactly equal to the second driving current, in a case that there is only one second transistor M2 in the current supplementing device 400; and the second driving current is N times the first driving current, in a case there are N second transistors M2 in the current supplementing device 400, where $N \geq 2$.

In some embodiments, a first terminal of each thin film transistor may refer to a source of such thin film transistor, a second terminal of each thin film transistor may refer to a drain of such thin film transistor, and a control terminal of each thin film transistor may refer to a gate of such thin film transistor. Other definitions of the terminals may also be feasible according to other embodiments of the present disclosure, which depends on types of the thin film transistors.

Figure 12:
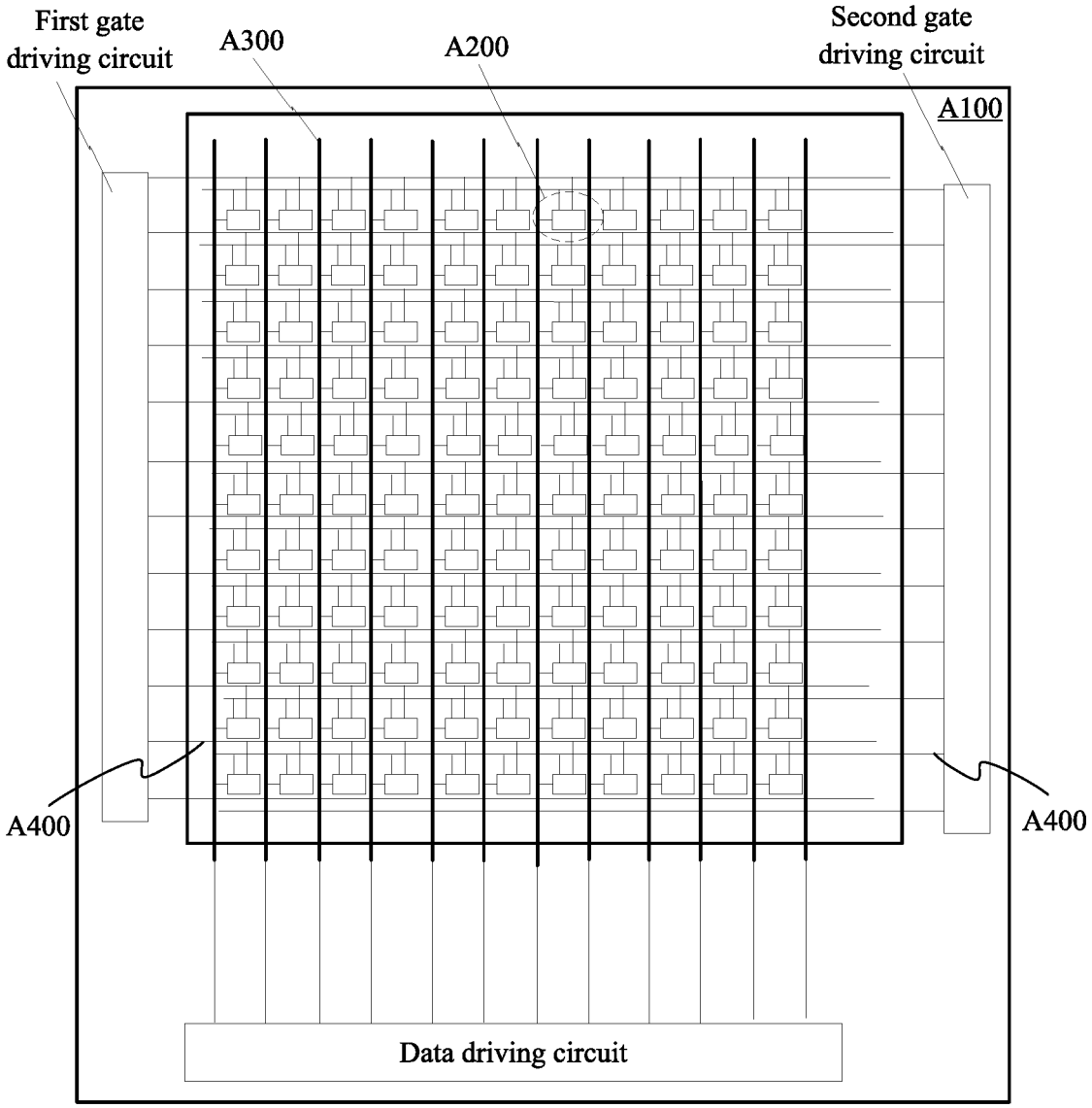
FIG. 12 is an schematic structural diagram of a top view of an array substrate according to an embodiment of the present disclosure.

Correspondingly, an array substrate is further provided according to an embodiment of the present disclosure. Reference is made to FIG. 12, which is a schematic structural diagram of a top view of an array substrate according to an embodiment of the present disclosure. The array substrate includes a substrate A100, multiple display units arranged in an array on the substrate A100, and a pixel circuit electrically connected to the display units. The pixel circuit includes a pixel circuit according to any of the foregoing embodiments.

FIG. 12 further illustrates a data driving circuit, a first gate driving circuit, a second gate driving circuit, multiple gate lines A400, and multiple data lines A300. The gate lines A400 and the data lines A300 intersect with each other. Regions defined by intersection between the gate lines A400 and the data lines A300 are configured to arrange the display units.

In FIG. 12, the array substrate may be driven in a cross driving mode. In some embodiments of the present disclosure, the array substrate may be driven in a double-edge driving mode or a single-edge driving mode. In some embodiments of the present disclosure, the pixel driving circuit, the first gate driving circuit, and the second gate driving circuit may be integrated in a same integrated circuit. A specific manner of implementation is not limited herein, and depends on a practical situation.

In FIG. 12, the reference numeral A200 represents a combination of the display units and the pixel circuit, instead of the display units or the pixel circuit that is separately illustrated.

Figure 13:
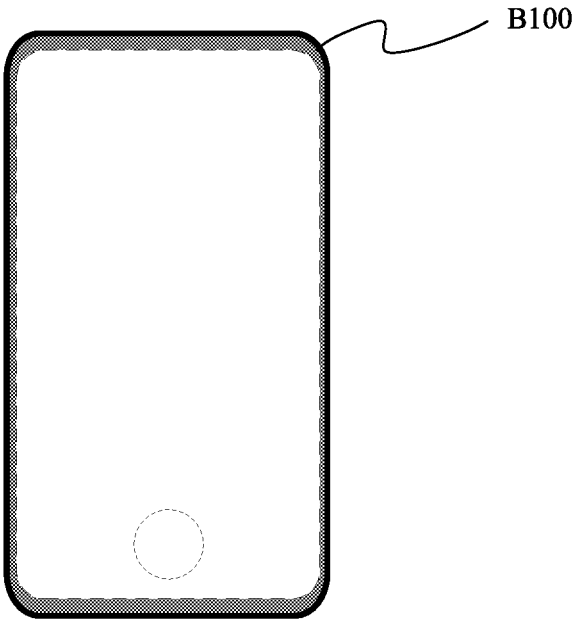
FIG. 13 is a schematic diagram of a display panel according to an embodiment of the present disclosure.

Correspondingly, a display panel is further provided according to an embodiment of the present disclosure. Reference is made to FIG. 13, which is a schematic diagram of a display panel B100 according to an embodiment of the present disclosure. The display panel B100 includes an array substrate and an opposite substrate that are disposed opposite to each other. The array substrate includes an array substrate according to the foregoing embodiments.

Structures such as a black matrix and a color film may be integrated on the array substrate through a color-filter-on-array (COA) technique. In such case, the opposite substrate may be a protective cover plate, for example, a glass cover plate or an acrylic cover plate with a protection function.

There may be no black matrix or color film on the array substrate. In such case, the opposite substrate may be a color film substrate, which includes a black matrix and a color film located in a region defined by the black matrix. Generally, the color film includes red color resistance, green color resistance and blue color resistance. In a case that the array substrate is a quantum dot array substrate, the color film may further include a red photo-conversion layer, a green photo-conversion layer, and a dispersion layer.

In summary, the pixel circuit, the array substrate, and the display panel are provided according to embodiments of the present disclosure. The pixel circuit includes the initializing device, the data writing device, the control device, and the current supplementing device. In the light-emitting phase of the driving period of the pixel circuit, the control device operates under control of the control signal, to generate the first driving current transmitted to the light-emitting unit. The current supplementing device operates under control of the control signal, to generate the second driving current transmitted to the light-emitting unit. The light-emitting unit is driven by the first driving current and the second driving current for light emission. A current driving the light-emitting unit for light emission is a sum of the first driving current and the second driving current. Therefore, currents that flowing through the control device and the current supplementing device, respectively, are reduced (that is, the first driving current and the second driving current are reduced) while meeting a requirement of providing a large driving current to the light-emitting unit. The control device and the current supplementing device are less likely to operate in a linear region, in a case that the pixel circuit is required to provide a large current to the light-emitting unit. Thereby, a control capability of the pixel unit on a current of the light-emitting unit is less likely to be weakened, and a display effect is improved.

Features described in embodiments of the present disclosure may be combined or replace each other. Each embodiment places emphasis on the difference from other embodiments. Therefore, one embodiment can refer to other embodiments for the same or similar parts.

What is claimed is:

1. A pixel circuit, comprising:

an initializing circuit, comprising a first input end;

a data writing circuit, comprising a second input end;

a control circuit, comprising a first power input end and a first output end; and a current supplementing circuit, comprising a second power input end and a second output end;

wherein each control end of the initializing circuit, the data writing circuit, the control circuit, and the current supplementing circuit is configured to receive a control signal;

wherein the first input end is configured to receive a reference signal, and the second input end is configured to receive a data signal;

wherein the first power input end and the second power input end are both configured to receive an operating voltage, the first output end is configured to output a first driving current, and the second output end is configured to output a second driving current;

wherein a driving period of the pixel circuit comprises a first phase, a second phase, and a light-emitting phase;

wherein in the light-emitting phase, the control signal is configured to:

control the control device to generate the first driving current according to the data signal and the operating voltage, wherein the first driving current is transmitted to a light-emitting unit;

control the current supplementing circuit to generate the second driving current according to the data signal and the operating voltage, wherein the second driving current is transmitted to the light-emitting unit;

wherein the light-emitting unit is driven by the first driving current and the second driving current for light emission, wherein the control signal is configured to:

control the initializing circuit to reset the pixel circuit through the reference signal in the first phase, and control the data writing circuit to write the data signal into the pixel circuit in the second phase; or control the initializing circuit to reset the pixel circuit through the reference signal and control the data writing circuit to write the data signal into the pixel circuit in the first phase, and perform threshold compensation on the initializing circuit in the second phase; and wherein the current supplementing circuit comprises a switch unit and a driving unit, the driving unit is biased to a first operation state based on the data signal in the second phase or the light-emitting phase, and the driving unit in the first operation state generates the second driving current based on the operating voltage, in response to the switch unit being turned on based on the control signal in the light-emitting phase.

2. The pixel circuit according to claim 1, wherein:

the switch unit comprises a first transistor;

a control terminal of the first transistor is configured to receive the control signal; and the first transistor is connected in series with the driving unit.

3. The pixel circuit according to claim 1, wherein:

the driving unit comprises at least one second transistor; and the at least one second transistor is biased to a second operation state based on the data signal in the second phase or the light-emitting phase.

4. The pixel circuit according to claim 3, wherein a quantity of the at least one second transistor is more than one, and the at least one second transistor are connected in parallel.

5. The pixel circuit according to claim 1, wherein:

the control signal comprises a first control signal, a second control signal, and a third control signal;

the initializing circuit further comprises a first control end and a second control end;

the data writing circuit further comprises a third control end;

the first control signal is inputted into the initializing circuit via the first control end, and is configured to control the initializing circuit to reset the pixel circuit through the reference signal in the first phase;

the second control signal is inputted into the initializing circuit via the second control end, and is inputted into the data writing circuit via the third control end;

the second control signal is configured to control the data writing circuit and the initializing circuit to write the data signal into the pixel circuit in the second phase; and the third control signal is configured to control the control circuit to generate the first driving current according to the data signal and the operating voltage in the light-emitting phase, and control the current supplementing circuit to generate the second driving current according to the data signal and the operating voltage in the light-emitting phase.

6. The pixel circuit according to claim 5, wherein:

the control circuit comprises a first control unit and a second control unit;

the first control unit is biased to a third operation state based on the data signal, in the second phase; and the first control unit in the third operation state generates the first driving current according to the operating voltage, in response to the second control unit being turned on based on third control signal during the light-emitting phase.

7. The pixel circuit according to claim 6, wherein:

the second control unit comprises a third transistor and a fourth transistor;

the first control unit comprises a fifth transistor;

a first terminal of the third transistor is configured to receive the operating voltage, a second terminal of the third transistor is electrically connected to a first terminal of the fifth transistor;

a first terminal of the fourth transistor is electrically connected to a second terminal of the fifth transistor, and a second terminal of the fourth transistor is electrically connected to an anode of the light-emitting unit;

control terminals of the third transistor and the fourth transistor are configured to receive the third control signal; and a control terminal of the fifth transistor is electrically connected to the initializing circuit.

8. The pixel circuit according to claim 7, wherein:

the data writing circuit comprises an eighth transistor, the initializing circuit comprises a first capacitor, a sixth transistor, a seventh transistor, and a ninth transistor; wherein, a control terminal of the sixth transistor and a control terminal of the eighth transistor are configured to receive the second control signal;

a control terminal of the seventh transistor and a control terminal of the ninth transistor are configured to receive the first control signal;

a first terminal of the sixth transistor is electrically connected to a terminal of the first capacitor and the control terminal of the fifth transistor, and a second terminal of the sixth transistor is electrically connected to a common node between the fifth transistor and the fourth transistor;

another terminal of the first capacitor is electrically connected to the first terminal of the third transistor;

a first terminal of the seventh transistor and a first terminal of the ninth transistor are both configured to receive the reference signal, and a second terminal of the seventh transistor is connected to the first terminal of the sixth transistor;

a first terminal of the eighth transistor is configured to receive the data signal, a second terminal of the eighth transistor is electrically connected to a common node between the third transistor and the fifth transistor;

a second terminal of the ninth transistor is electrically connected to a common node between the fourth transistor and the light-emitting unit.

9. The pixel circuit according to claim 1, wherein:

the control signal comprises a fourth control signal, a fifth control signal, and a sixth control signal;

the initializing circuit further comprises a fourth control end and a fifth control end;

the data writing circuit further comprises a sixth control end;

the fourth control signal is inputted into the initializing circuit via the fourth control end;

the fifth control signal is inputted into the data writing circuit via the sixth control end;

the sixth control signal is inputted into the control circuit and the current supplementing circuit, and is inputted into the initializing circuit via the fifth control end;

the fourth control signal is configured to control the control circuit to reset the pixel circuit through the reference signal in the first phase;

the fifth control signal is configured to control the data writing circuit to write the data signal into the pixel circuit in the first phase, and perform the threshold compensation on the initializing circuit in the second phase; and the sixth control signal is configured to, in the light-emitting phase:

control the control circuit to generate the first driving current according to the data signal and the operating voltage, and control the current supplementing circuit to generate the second driving current according to the data signal and the operating voltage, wherein the first driving current and the second driving current are transmitted to the light-emitting unit.

10. The pixel circuit according to claim 9, wherein the control circuit comprises a tenth transistor and an eleventh transistor;

a control terminal of the tenth transistor is electrically connected to the initializing circuit;

a control terminal of the eleventh transistor is electrically connected to the switch unit, and is configure to receive the sixth control signal;

a first terminal of the tenth transistor is configured to receive the operating voltage, a second terminal of the tenth transistor is electrically connected to a first terminal of the eleventh transistor, and a second terminal of the eleventh transistor is electrically connected to an anode of the light-emitting unit.

11. The pixel circuit according to claim 10, wherein:

the data writing circuit comprises a thirteenth transistor;

the initializing circuit comprises a second capacitor, a twelfth transistor, a fourteenth transistor, a fifteenth transistor, a sixteenth transistor, and a seventeenth transistor;

a control terminal of the twelfth transistor is configured to receive the sixth control signal, a first terminal of the twelfth transistor is configured to receive the reference signal, and a second terminal of the twelfth transistor is electrically connected to a terminal of the second capacitor;

another terminal of the second capacitor is electrically connected to a first terminal of the fourteenth transistor and the control terminal of the tenth transistor;

a control terminal of the thirteenth transistor is configured to receive the fifth control signal, a first terminal of the thirteenth transistor is configured to receive the data signal, and a second terminal of the thirteenth transistor is connected to the second terminal of the twelfth transistor;

a control terminal of the fourteenth transistor, a control terminal of the seventeenth transistor, and a control terminal of the fifteenth transistor are all configured to receive the fifth control signal;

a second terminal of the fourteenth transistor is electrically connected to a first terminal of the seventeenth transistor;

a first terminal of the fifteenth transistor is electrically connected to a second terminal of the sixteenth transistor, and a second terminal of the fifteenth transistor is connected to the second terminal of the fourteenth transistor;

a first terminal of the sixteenth transistor is configured to receive the reference signal, and a control terminal of the sixteenth transistor is configured to receive the sixth control signal; and a second terminal of the seventeenth transistor is electrically connected to a common node between the tenth transistor and the eleventh transistor.

12. The pixel circuit according to claim 1, wherein:

the control signal comprises a seventh control signal, an eighth control signal, and a ninth control signal;

the initializing circuit further comprises a seventh control end;

the data writing circuit further comprises an eighth control end;

the seventh control signal is inputted into the control circuit and the current supplementing circuit;

the eighth control signal is inputted into the initializing circuit via the seventh control end;

the ninth control signal is inputted into the data writing circuit via the eighth control end;

the eighth control signal is configured to control the initializing circuit to reset the pixel circuit through the reference signal in the first phase;

the ninth control signal is configured to control the data writing circuit to write the data signal into the pixel circuit in the second phase;

the seventh control signal is configured to, in the light-emitting phase:

control the control circuit to generate the first driving current according to the data signal and the operating voltage, and control the current supplementing circuit to generate the second driving current according to the data signal and the operating voltage.

13. The pixel circuit according to claim 12, wherein:

the control circuit comprises an eighteenth transistor and a nineteenth transistor;

a control terminal of the eighteenth transistor is electrically connected to the initializing circuit;

a control terminal of the nineteenth transistor is electrically connected to the current supplementing circuit, and is configured to receive the seventh control signal; and a first terminal of the eighteenth transistor is configured to receive the operating voltage, a second terminal of the eighteenth transistor is electrically connected to a first terminal of the nineteenth transistor, and a second terminal of the nineteenth transistor is electrically connected to an anode of the light-emitting unit.

14. The pixel circuit according to claim 13, wherein:

the initializing circuit comprises a third capacitor, a twentieth transistor, and a twenty-first transistor;

the data writing circuit comprises a twenty-second transistor;

a control terminal of the twentieth transistor is configured to receive the eighth control signal, a first terminal of the twentieth transistor is electrically connected to a terminal of the third capacitor and the control terminal of the eighteenth transistor, a second terminal of the twentieth transistor is electrically connected to the second terminal of the eighteenth transistor and the first terminal of the nineteenth transistor;

a control terminal of the twenty-first transistor is configured to receive the eighth control signal, and a first terminal of the twenty-first transistor is configured to receive the reference signal;

a control terminal of the twenty-second transistor is configured to receive the ninth control signal, a first terminal of the twenty-second transistor is configured to receive the data signal, and a second terminal of the twenty-second transistor is electrically connected to a second terminal of the twenty-first transistor and another terminal of the third capacitor.

15. An array substrate, comprising:

a substrate;

a plurality of display units arranged in an array on the substrate; and a pixel circuit, electrically connected to the plurality of display units;

wherein the pixel unit comprises:

an initializing circuit, comprising a first input end;

a data writing circuit, comprising a second input end;

a control circuit, comprising a first power input end and a first output end; and a current supplementing circuit, comprising a second power input end and a second output end;

wherein each control end of the initializing circuit, the data writing circuit, the control circuit, and the current supplementing circuit is configured to receive a control signal;

wherein the first input end is configured to receive a reference signal, and the second input end is configured to receive a data signal;

wherein the first power input end and the second power input end are both configured to receive an operating voltage, the first output end is configured to output a first driving current, and the second output end is configured to output a second driving current;

wherein a driving period of the pixel circuit comprises a first phase, a second phase, and a light-emitting phase;

wherein in the light-emitting phase, the control signal is configured to:

control the control circuit to generate the first driving current according to the data signal and the operating voltage, wherein the first driving current is transmitted to a light-emitting unit;

control the current supplementing circuit to generate the second driving current according to the data signal and the operating voltage, wherein the second driving current is transmitted to the light-emitting unit;

wherein the light-emitting unit is driven by the first driving current and the second driving current for light emission;

wherein the control signal is configured to:

control the initializing circuit to reset the pixel circuit through the reference signal in the first phase, and control the data writing circuit to write the data signal into the pixel circuit in the second phase; or control the initializing circuit to reset the pixel circuit through the reference signal and control the data writing circuit to write the data signal into the pixel circuit in the first phase, and perform threshold compensation on the initializing circuit in the second phase; and wherein the current supplementing circuit comprises a switch unit and a driving unit, the driving unit is biased to a first operation state based on the data signal in the second phase or the light-emitting phase, and the driving unit in the first operation state generates the second driving current based on the operating voltage, in response to the switch unit being turned on based on the control signal in the light-emitting phase.

16. A display panel, comprising:

an array substrate; and an opposite substrate;

wherein the array substrate and the opposite substrate are disposed opposite to each other;

wherein the array substrate comprises:

a substrate;

a plurality of display units arranged in an array on the substrate; and a pixel circuit, electrically connected to the plurality of display units;

wherein the pixel unit comprises:

an initializing circuit, comprising a first input end;

a data writing circuit, comprising a second input end;

a control circuit, comprising a first power input end and a first output end; and a current supplementing circuit, comprising a second power input end and a second output end;

wherein each control end of the initializing circuit, the data writing circuit, the control circuit, and the current supplementing circuit is configured to receive a control signal;

wherein the first input end is configured to receive a reference signal, and the second input end is configured to receive a data signal;

wherein the first power input end and the second power input end are both configured to receive an operating voltage, the first output end is configured to output a first driving current, and the second output end is configured to output a second driving current;

wherein a driving period of the pixel circuit comprises a first phase, a second phase, and a light-emitting phase;

wherein in the light-emitting phase, the control signal is configured to:

control the control circuit to generate the first driving current according to the data signal and the operating voltage, wherein the first driving current is transmitted to a light-emitting unit;

control the current supplementing circuit to generate the second driving current according to the data signal and the operating voltage, wherein the second driving current is transmitted to the light-emitting unit;

wherein the light-emitting unit is driven by the first driving current and the second driving current for light emission;

wherein the control signal is configured to:

control the initializing circuit to reset the pixel circuit through the reference signal in the first phase, and control the data writing circuit to write the data signal into the pixel circuit in the second phase; or control the initializing circuit to reset the pixel circuit through the reference signal and control the data writing circuit to write the data signal into the pixel circuit in the first phase, and perform threshold compensation on the initializing circuit in the second phase; and wherein the current supplementing circuit comprises a switch unit and a driving unit, the driving unit is biased to a first operation state based on the data signal in the second phase or the light-emitting phase, and the driving unit in the first operation state generates the second driving current based on the operating voltage, in response to the switch unit being turned on based on the control signal in the light-emitting phase.

* * * * *